United States Patent [19]

Schreiner

[11] 4,178,779

[45] Dec. 18, 1979

[54] STITCH CAMS FOR CIRCULAR KNITTING MACHINES

[75] Inventor: Juan M. Schreiner, Barcelona, Spain

[73] Assignee: Jumberca, S.A., Spain

[21] Appl. No.: 881,368

[22] Filed: Feb. 27, 1978

[51] Int. Cl.[2] ..... D04B 15/32

[52] U.S. Cl. ..... 66/54

[58] Field of Search ..... 66/20, 23, 27, 54, 77

[56] References Cited

U.S. PATENT DOCUMENTS

| | | | |
|---|---|---|---|
| 465,842 | 12/1891 | Dow | 66/23 UX |
| 1,531,422 | 3/1925 | Simond | 66/20 |
| 2,150,730 | 3/1939 | Schuessler | 66/77 |
| 2,748,580 | 6/1956 | Zeruneith | 66/20 |
| 3,869,879 | 3/1975 | Brunner | 66/27 X |

*Primary Examiner*—Wm. Carter Reynolds

*Attorney, Agent, or Firm*—Staas & Halsey

[57] ABSTRACT

The invention relates to movable stitch cams for circular knitting machines wherein the stitch adjustment is effected by rotation of the cam around an axis of rotation and wherein the main portion of the active portion of the cam lies on an arc of a circle having its center on the axis of rotation of the cam.

4 Claims, 11 Drawing Figures

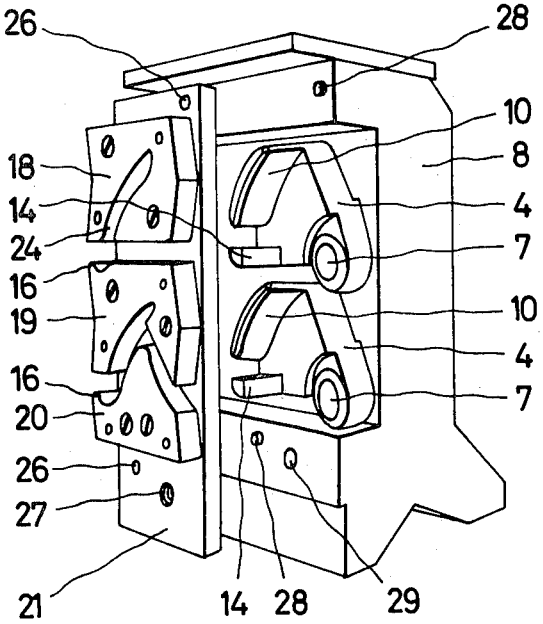
FIG. 4
FIG. 5
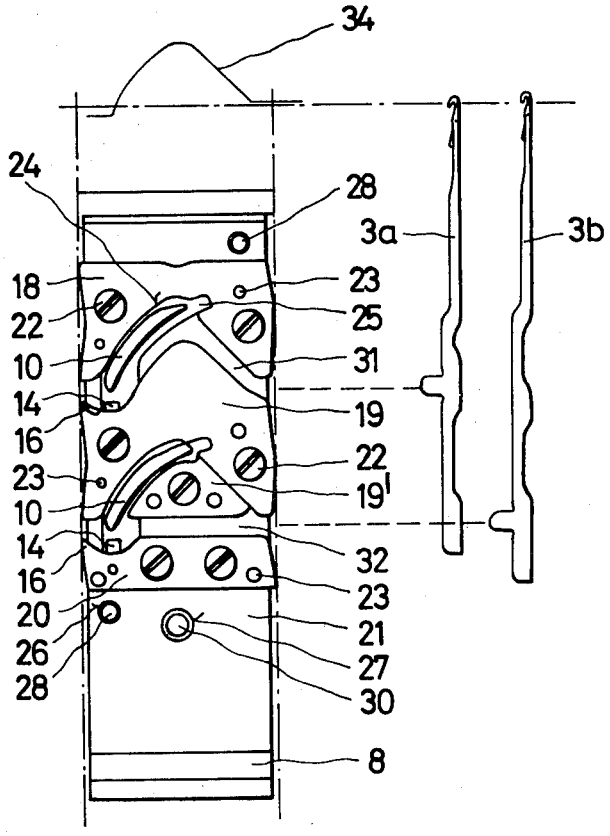

STITCH CAMS FOR CIRCULAR KNITTING MACHINES

FIELD OF THE INVENTION

The present invention relates to improvements in or relating to stitch cams for circular knitting machines, and more particularly to moving stitch cams, wherein the adjustment of the stitch by positioning of the cams, is effected by rotation of the cam around an axis of rotation.

DESCRIPTION OF THE PRIOR ART

Normally, the operative portion of the stitch cams, that is, the portion engaging the needle during the downward movement thereof, is a straight line surface forming an angle to the vertical plane or is an angled straight line surface at its lower half and is curved at the upper end thereof. But with the above arrangement, it happens that since the stitch cam is adjusted from minimum to maximum in the vertical direction thereof, the point of contact with the needle in its trajectory varies, depending on the vertical adjustment of the cam, so that the angle of contact varies and the cam is struck sharply by the needle, thereby causing vibration of the needle and possible breakage thereof, apart from varying the position of the point of closing of the needle latch.

In other known embodiments, the stitch cam is adjusted from minimum to maximum along a line parallel to the angular slope of the cam, whereby it moves diagonally and, although in this case the position of the point of closing of the needle latch does not vary over the whole of the stitch forming movement, the above mentioned disadvantage of the sharp blow of the needle against the cam still subsists.

SUMMARY OF THE INVENTION

It is an object of this invention to provide greater protection for the needles during their trajectory over the active portion of the cam, to avoid the sharp blow of the needles on inciding on said cam portion and to ensure the same position of the needle latch closing point during the drawing thereof down said cam portion, irrespctively of the position of the cam over its full range of adjustment, for correct knitting operation. This enables high knitting speeds to be obtained with the highest level of reliability as far as needle breakage is concerned.

According to the invention, the main portion of the active portion of the cam lies along an arc of a circle, the centre of which lies on the axis of rotation of the cam, so that the angle of attack and the needle latch closing point in said main portion of the active portion of the cam remain constant for any position of the cam lying between the maximum and minimum positions of stitch graduation.

One feature of the invention is to be found in the fact that the active portion of the cam is provided, after the said main portion, with a portion of lesser curvature providing a slight run-out angle to ease the descent of the needle in its point of maximum drawing-down.

A further feature of the invention consists of the adjustment of the stitch cam position for stitch adjustment being effected by the intermediary of an eccentric mechanism, which is actuated by rotary hand operated control from the rear of the cam plate support.

Yet a further feature of the invention is that where two or more cams are provided, these are associated with a bar pivotally mounted to each of said cams to provide for simultaneous stitch adjustment of all of them.

BRIEF DESCRIPTION OF THE DRAWINGS

To facilitate the understanding of the foregoing ideas, there is described hereinafter various embodiments of the invention, with reference to the accompanying drawings which, in view of their illustrative nature, are to be construed as devoid of any limitating scope with respect to the legal protection being applied for.

In the drawings:

FIG. 4 is an exploded perspective view of the operative section of a cam cylinder showing the relative positions of the support, support plate, fixed cams and stitch cams in the case of a circular interlock knitting machine.

FIG. 5 is a front view of an operative section of a circular knitting machine cylinder, with two cam tracks, with the needles being shown schematically with their butts opposed to their respective tracks.

DETAILED DESCRIPTION OF THE INVENTION

Figure 1:
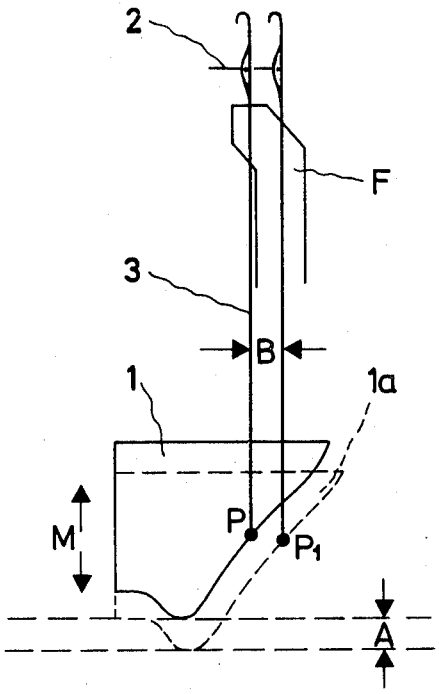
FIG. 1 Prior Art
FIG. 1 is a diagrammatic view of the positions occupied by a conventional stitch cam before and after a stitch adjustment and the relative position of a needle in each of said positions.

In FIG. 1 there is illustrated a conventional stitch cam 1 of the type wherein the stitch adjustment is effected by a rectilinear movement of the cam in a direction M. In this case, when the stitch is adjusted in an amount A, the cam reaches the position of the phantom cam 1*a*, whereby the closing point of the latch 2 of a needle 3 is moved by an amount B from the position P to the position $P_1$. It should be observed that the latch 2 closes by the retaining effect exerted by the needle bed F on the previous stitch.

Figure 2:
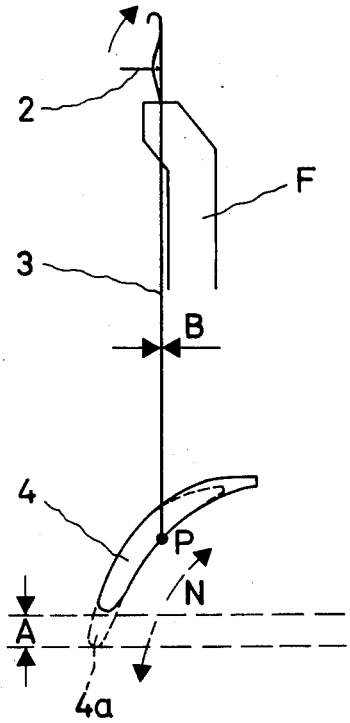
FIG. 2 is a diagrammatic view similar to the previous Figure of the positions occupied by a stitch cam according to the invention before and after an adjustment of the stitch and the relative position of a needle with respect to said positions.

Contrarywise, as illustrated in FIG. 2, in a stitch cam 4 according to the invention, when the latch closing is adjusted by rotating the cam 4 in the direction of the double headed arrow N to a position illustrated by the phantom cam 4*a* over a distance A equal to the distance A of the previous Figure, the closing point P of the latch 2 of a needle 3 remains unchanged, because, since the path of the active portion of the cam 4 with the above latch closing modification is not varied, the value of the corresponding amount B is reduced to zero.

Figure 3:
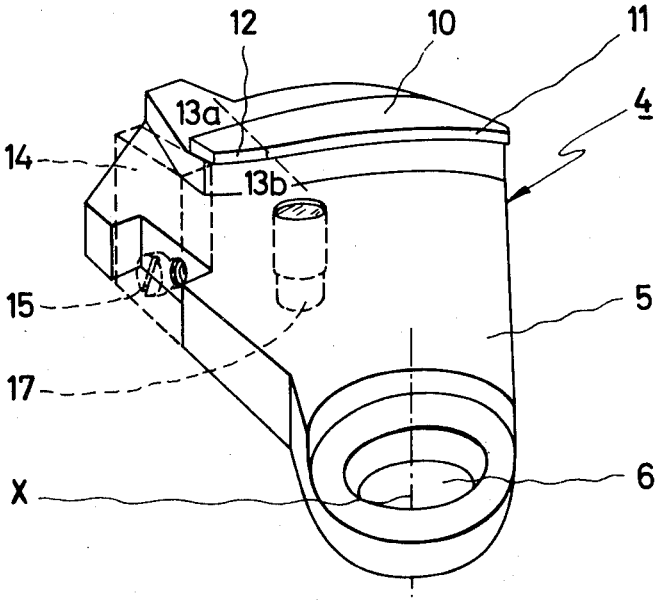
FIG. 3 is a perspective view of a stitch cam embodiment according to the invention.

A stitch cam 4 according to the invention, as shown in FIG. 3, comprises a substantially triangular body 5 with an orifice 6 close to one corner for pivotal mounting to a shfat 7 attached to a support 8 of an operative section of a cam cylinder, as an example of application to a circular knitting machine of the interlock type.

In the cam 4 of the invention, said active portion 10 is provided with a contact surface for the needle butts, said surface comprising a main portion describing a cylindrical arc 11 the radius of which extends to the axis of rotation X, followed by a cylindrical arc 12 distinguished from the previous arc by a line 13*a*–13*b* of FIG. 3 and having a lesser radius of curvature and forming said run-out angle for the needles 3 which is intended to ease the movement of the needles in their point of maximum draw.

Said stitch cam 4 is provided with a pin 14 facing its active portion exit end. If said pin is made removeable, it may be held in place by a screw 15. Said pin is intended to provide a constant run-out height for the needles 3 in any case, irrespectively of the positions of said cam 4. In the lowermost position of said cam 4, the function of said pin 14 is replaced by a shoulder 16 of the corresponding fixed cam which in such case is accessible to the needles 3. The cam 4 is provided with a pin 17 on the rear face thereof for controlling the movements of the cam.

The fixed cams 18, 19 and 20 are mounted on a support plate 21 by screws 22 and locating pins 23. Said fixed cams 18, 19 and 20 are provided with slots 24 mating with apertures 25 in the support plate 21 for passage of the active portion 10 of the moving cams 4. The fixed cams 18, 19 and 20 may be supplemented with fixed auxiliary cams 19' as illustrated in FIG. 5.

Figure 9:
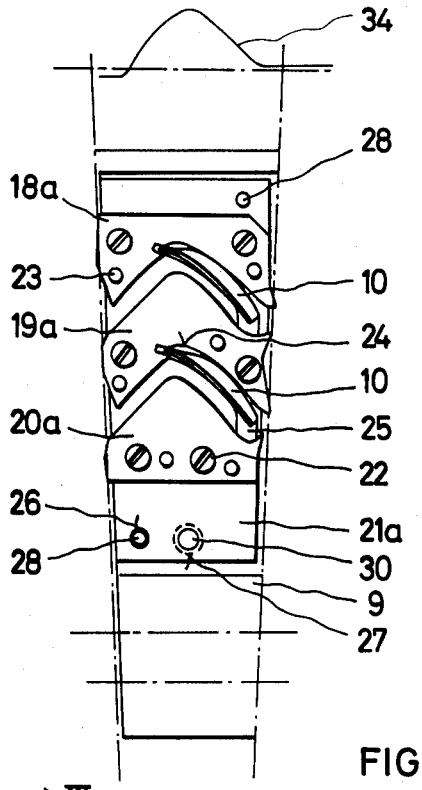
FIG. 9 is a front view of an operative section of a circular knitting machine dial with two cam tracks.
Figure 10:
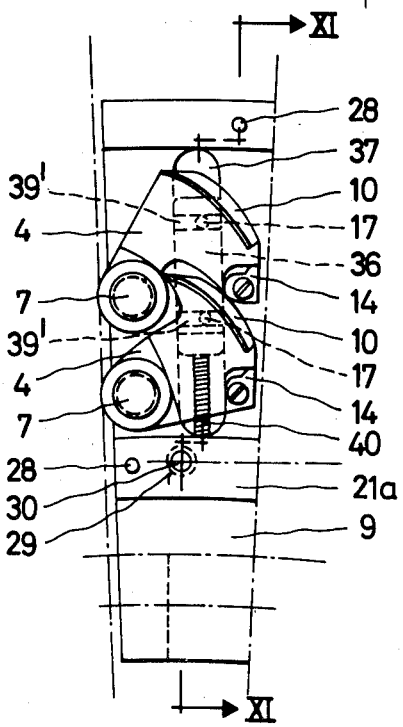
FIG. 10 is a front view of the operative section of FIG. 9, wherein similarly to FIG. 7. the fixed cam plate has also been removed.
Figure 11:
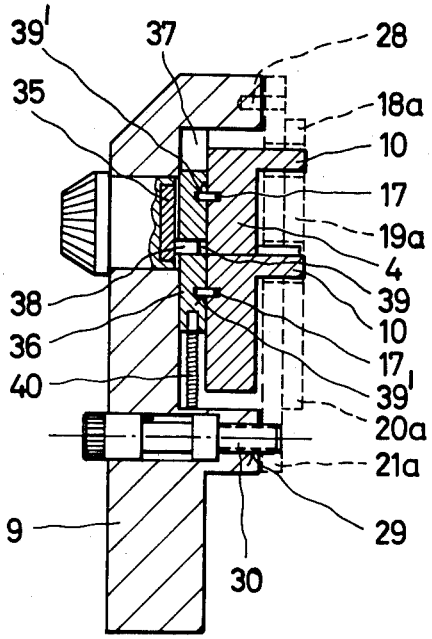
FIG. 11 is a sectional view along the line XI—XI of FIG. 9.

The support plates 21 of the cam cylinder (FIGS. 4–8) or 21*a* of the cam dial (FIGS. 9–11), with their fixed cams 18, 19 and 20, and 18*a*, 19*a* and 20*a*, respectively, are mounted in the corresponding supports 8 and 9 of the operative sections of the cam cylinder or dial, by the intermediary of an arrangement of through hole 26 and threaded hole 27 mating respectively with locating pins 28 and through holes 29 in the support 8 or 9, said through holes 29 and threaded holes 27 being supplemented by a holding screw 30. This arrangement greatly facilitates changeovers of the fixed cam assembly mounted on each support plate 21 or 21*a*, allowing the evolution of the needles to be changed in a simple manner to change the cloth construction. In FIG. 5 there is shown a support plate 21 which, with fixed cams 18, 19, 19' and 20 provides an operative track for the short needles 3*a* and a cancellation track for the long needles 3*b*, the path described by the short needles 3*a* having been indicated by 34.

The stitch cams 4 are activated by an eccentric mechanism 35 acting directly on the pin 17 of the cam 4 (a form not shown in the drawings) when there is only one cam 4 or indirectly when there are two or more cams 4, through a bar 36 sliding in a slot 37 of the support 8 or 9, in which case the eccentric mechanism 35 is provided with a pin 38 housed in an orifice 39 of the bar 36 while the pins 17 of the cams 4 are housed in slots 39' of said bar 36 which is urged by a compression spring 40.

To produce the different types of fabric construction in an interlock machine, there are fixed cams 18, 19 and 20 for the cam cylinder and 18*a*, 19*a* and 20*a* for the cam dial. Said cams are adapted for providing the appropriate tracks for the needles 3, that is, the said operative track 31, cancellation track 32 or tuck stitch track 41 (see FIG. 6), the desired combinations being obtained by the convenient short 3*a* or long 3*b* needles, both on the cylinder and on the dial. Since each operative section of the cylinder and of the dial of a circular knitting machine offers the same characteristics and the same possibilities, when a fabric construction change is desired, it is sufficient only to change the necessary support plates 21 or 21*a* carrying the sets of fixed cams 18, 19, 20 and 18*a*, 19*a*, 20*a*. This may be done quickly and reliably, as explained above, thanks to the holding screw 30 and locating pins 28.

Figure 6:
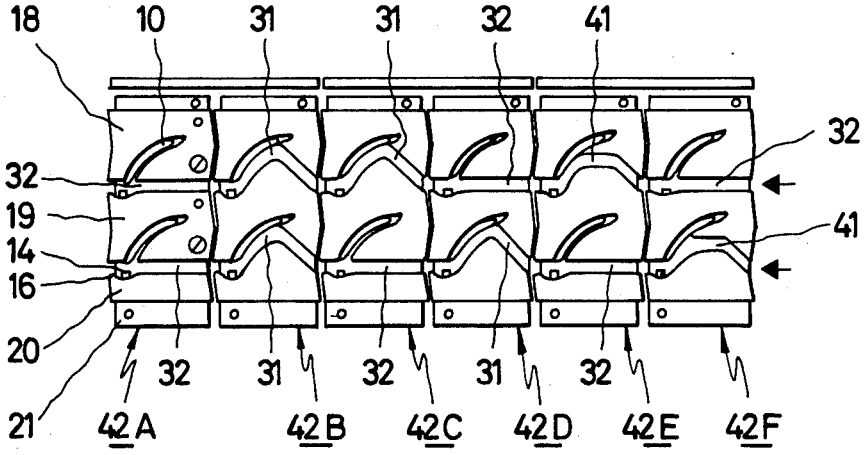
FIG. 6 is a front view in plane development of sections of the cam cylinder having several types of plates for fixed cams for providing different operative possibilities of the needles.
Figure 7:
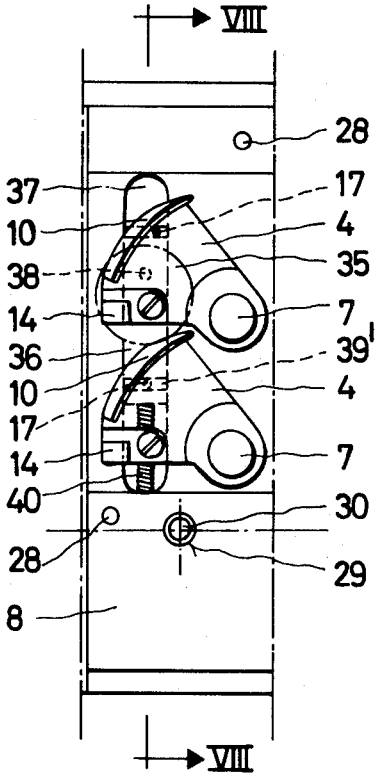
FIG. 7 is a front view of the operative section of FIG. 5, wherein the fixed cam plate has been removed.
Figure 8:
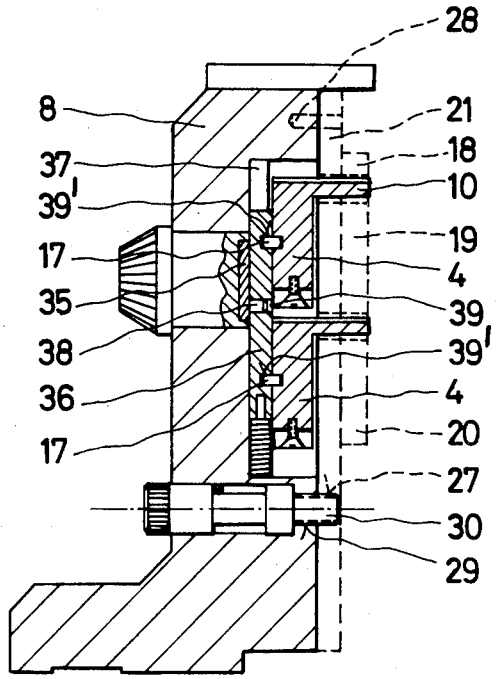
FIG. 8 is a sectional view along the line VIII—VIII of FIG. 7.

Thus there are shown in FIG. 6 as an exemplification various layouts of the fixed cams 18, 19 and 20 to provide different fabric constructions. In Section 42A there are two cancellation tracks 32, in section 42B there are two operative tracks 31, in section 42C there is an upper operative track 31 and a lower cancellation track 3, in section 42D there is an upper cancellation track 32 and a lower operative track 31, in section 42E there is an upper tuck stitch track 41 and a lower cancellation track 32 and in section 42F there is an upper cancellation track 32 and a lower tuck stitch track 41.

In view of the special shape of the stitch cams and their up and down movement for stitch adjustment, it is possible to knit at any adjustment without having to vary the position of the yarn guides, since the latches of the needles 3 always close at the same point. For the same reason, there will be no variation either in the synchronism between the dial needles and the cylinder needles. Likewise, the passage of the needles between the cam and countercam is held always constant. These features are of great importance in machines having many sets, with the possibility of knitting several constructions wherein there are different stitch graduations.

Thus, the present invention includes the improvement wherein the main portion of the active portion of the stitch cam is disposed along an arc having the same center as the axis of rotation of the cam, the angle of incidence and the point of closing of the needle latches on said main portion of the cam active portion remaining constant for any position of the cam between the maximum and minimum stitch graduation thereof.

What I claim is:

1. In circular knitting machines having stitch cams and needles in which a stitch adjustment is effected by rotating a cam around an axis of rotation, the improvement wherein the main portion of an active portion of the cam is disposed along an arc having the same center as the axis of rotation of the cam, the angle of incidence and the point of closing of the needle latches on said main portion of the can active portion remaining constant for any position of the cam between the maximum and minimum stitch graduation.

2. The improvement of claim 1, wherein the said active portion of the cam is provided immediately adjacent and following said main portion with a portion of lesser curvature forming a slight run-out angle for easing the descent of the needles at the point of maximum draw.

3. The improvement of claim 1, wherein the adjustment of the stitch cam position to adjust the stitch is effected by an eccentric mechanism controlled by a rotary hand control from the rear of a cam plate support.

4. The improvement of claim 1, wherein when there are two or more stitch cams on the same cam plate, they are associated with each other by a bar attached to each of said cams, thereby providing simultaneous adjustment of the stitch on all of said cams.

* * * * *

UNITED STATES PATENT AND TRADEMARK OFFICE

CERTIFICATE OF CORRECTION

PATENT NO. : 4,178,779

DATED : December 18, 1979

INVENTOR(S) : JUAN M. SCHREINER

It is certified that error appears in the above-identified patent and that said Letters Patent are hereby corrected as shown below:

* Col. 1, line 51, "centre" should be --center--;

Col. 3, line 7, "shfat" should be --shaft--;

* Col. 4, line 50, "can" should be --cam--.

Signed and Sealed this

*Twenty-ninth* Day of *April 1980*

[SEAL]

*Attest:*

SIDNEY A. DIAMOND

*Attesting Officer*

*Commissioner of Patents and Trademarks*